US012723502B2

(12) United States Patent
Liu et al.

(10) Patent No.: US 12,723,502 B2
(45) Date of Patent: Sep. 1, 2026

(54) BRITTLE-BURST STRENGTH FOR WELL SYSTEM TUBULAR INTEGRITY

(71) Applicant: Landmark Graphics Corporation, Houston, TX (US)

(72) Inventors: Zhengchun Michael Liu, Sugar Land, TX (US); Robello Samuel, Cypress, TX (US); Adolfo Gonzales, Houston, TX (US); Yongfeng Kang, Katy, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 492 days.

(21) Appl. No.: 17/970,862

(22) Filed: Oct. 21, 2022

(65) Prior Publication Data

US 2024/0133288 A1 Apr. 25, 2024
US 2024/0229636 A9 Jul. 11, 2024

(51) Int. Cl.

| | |
|---|---|
| ***E21B 47/007*** | (2012.01) |
| *E21B 41/00* | (2006.01) |
| *E21B 43/26* | (2006.01) |
| *E21B 47/00* | (2012.01) |
| *E21B 47/06* | (2012.01) |

(52) U.S. Cl.
CPC ..... *E21B 47/007* (2020.05); *E21B 41/00* (2013.01); *E21B 43/26* (2013.01); *E21B 47/00* (2013.01); *E21B 47/06* (2013.01)

(58) Field of Classification Search
None
See application file for complete search history.

(56) References Cited

U.S. PATENT DOCUMENTS 11,270,048 B2 * 3/2022 Han ..... G06F 30/23
2004/0221985 A1 11/2004 Hill et al.
(Continued)

FOREIGN PATENT DOCUMENTS

WO 2016025782 A1 2/2016
WO 2021222422 A1 11/2021

OTHER PUBLICATIONS

Elramady, Alyaa Gamal—"The Effect of Various Deformation Processes on the Corrosion Behavior of Casing and Tubing Carbon Steels in Sweet Environment." (Year: 2015).*
(Continued)

*Primary Examiner* — Arleen M Vazquez
*Assistant Examiner* — Leonard S Liang
(74) *Attorney, Agent, or Firm* — Kilpatrick Townsend & Stockton LLP

(57) ABSTRACT

A system can receive data relating to a tubular of a well system. The system can execute a first module to determine first outputs. The system can execute a second module to determine second outputs based on the first outputs. The system can execute a third module to determine third outputs based on the first outputs. The second outputs can include a crack-initiation fracture pressure, and the third outputs can include a crack-propagation fracture pressure. The system can identify a brittle-burst strength of the tubular from among the second outputs, the third outputs, and a standard burst strength of the tubular. The system can provide the brittle-burst strength of the tubular to facilitate an adjustment to the tubular to optimize a wellbore operation associated with the well system.

16 Claims, 6 Drawing Sheets

(56) References Cited

U.S. PATENT DOCUMENTS

| | | | | |
|---|---|---|---|---|
| 2014/0039797 | A1* | 2/2014 | Gonzales | E21B 47/00 702/11 |
| 2016/0237804 | A1 | 8/2016 | Papadimitriou et al. | |
| 2016/0258040 | A1* | 9/2016 | Schutz | C22C 14/00 |
| 2017/0058669 | A1* | 3/2017 | Lakings | E21B 49/003 |
| 2017/0175505 | A1* | 6/2017 | Curlett | E21B 43/20 |
| 2018/0142536 | A1* | 5/2018 | Liu | G06F 30/20 |
| 2022/0136370 | A1 | 5/2022 | Liu et al. | |
| 2022/0205340 | A1 | 6/2022 | Liu et al. | |
| 2022/0268142 | A1* | 8/2022 | Schmidt | C09K 8/88 |

OTHER PUBLICATIONS

Tallin, A.G. and Burres, C.V.—"The Development of Risk-Based Burst Design for Well Casing and Tubing"; 1998 (Year: 1998).*

Lee, Jonathan A.—"Hydrogen Embrittlement"; NASA/TM-2016-218602; Apr. 2016 (Year: 2016).*

International Search Report and Written Opinion, PCT/US2023/030883, Dec. 20, 2023, 9 pages.

Calculating Performance Properties of Pipe Used as Casing or Tubing, API Technical Report 5C3 Seventh Edition, Jun. 2018, 400 pages.

Case et al., Fracture Toughness Assessment of the Susceptibility for Sulfide Stress Corrosion Cracking in High Strength Carbon and Low Alloy Steels: A Review, NACE Corrosion Conference and Expo, Paper No. 10851, Apr. 15, 2018, 18 pages.

Miyata et al., Mezzo-Scopic Analysis of Fracture Toughness in Steels, Materials Research, vol. 5, No. 2, 2002, pp. 85-93.

Mahdavi, "Calculation of Fracture Toughness for Hydrogen Embrittlement in a Pressure Vessel", Trans Tech Publications, Dec. 1, 2009, 18 pages.

Tomson, et al., "Measurement of total alkalinity and carboxylic acid and their relation to scaling and corrosion", Society of Petroleum Engineers, Mar. 2006, 8 pages.

Wasim, et al., "Influence of hydrogen-enhanced plasticity and decohesion mechanisms of hydrogen embrittlement on the fracture resistance of steel", Engineering Failure Analysis, vol. 123, May 2021, 45 pages.

* cited by examiner

BRITTLE-BURST STRENGTH FOR WELL SYSTEM TUBULAR INTEGRITY

TECHNICAL FIELD

The present disclosure relates generally to wellbore operations and, more particularly (although not necessarily exclusively), to brittle-burst strength for well system tubular integrity.

BACKGROUND

A well system can include a wellbore that can be formed in a subterranean formation for extracting produced hydrocarbon or other suitable material. A wellbore operation can be performed to extract the produced hydrocarbon material or perform other suitable tasks relating to the wellbore. During the wellbore operation, a tubular, such as a casing string, a production string, surface piping, or the like, can be used to perform or facilitate the wellbore operation. The tubular may be exposed to harsh conditions that may degrade the tubular over time or may otherwise affect the integrity of the tubular.

DETAILED DESCRIPTION

Figure 1:
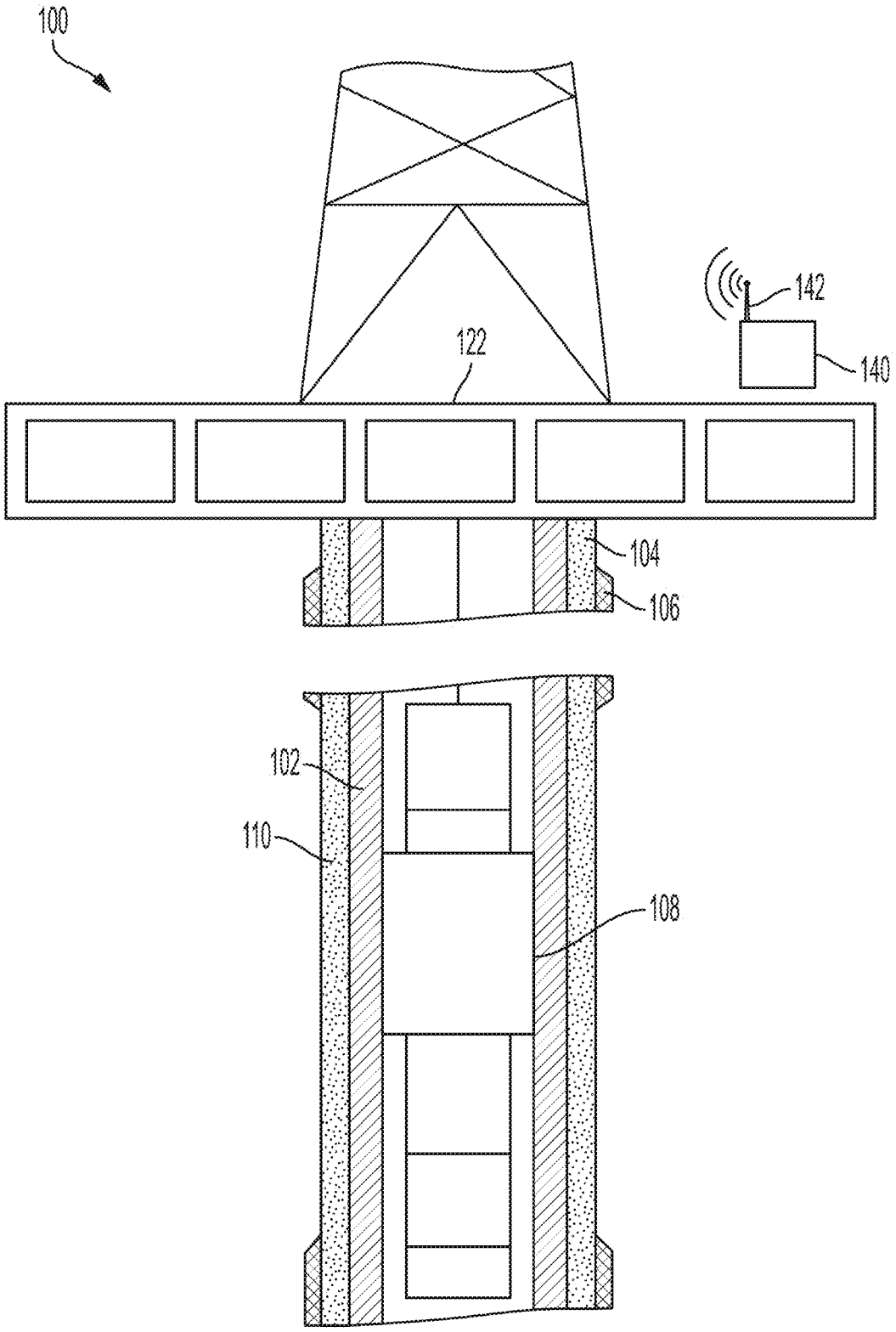
FIG. 1 is a schematic of a well system with a tubular that includes a brittle-burst strength that represents an integrity of the tubular according to one example of the present disclosure.

Certain aspects and examples of the present disclosure relate to determining brittle-burst strength for a tubular associated with a well system for determining an integrity of the tubular. The tubular may include a downhole tubular that can be positioned in a wellbore of the well system, a surface tubular that can be positioned at the surface of the well system, or a combination thereof. The downhole tubular can include a casing string, a tubing string, or the like, and the surface tubular can include a surface pipeline, etc. The tubular can be used with respect to one or more wellbore operations of the well system. For example, the tubular can transport material produced from the wellbore, material for use in the wellbore, etc. In some examples, the tubular can include carbon steel or carbon-steel-based alloys. The tubular may experience sour environments with respect to the wellbore. For example, a downhole tubular may experience a sour environment that includes a combination of water, carbon dioxide, and hydrogen sulfide, a surface tubular may experience a sour environment that includes a combination of water and carbon dioxide, and the like. The tubular may degrade over time when exposed to the sour conditions. For example, the tubular may experience cracking due to ductile deformations, brittle-burst cracking, and other similar cracking or damage mechanisms. Brittle-burst cracking may include cracks that result from the sour environment and without the tubular experiencing plastic deformation. Brittle-burst strength may indicate an integrity design limit of the tubular and may be used to optimize the tubular used for different wellbore operations.

High-strength carbon steels can be used in wellbore operations and can be susceptible to brittle-burst failure, such as cracking, when in service in a sour environment, which can include media with water and carbon dioxide, hydrogen sulfide, or a combination thereof. The brittle-burst failure can involve cracking without plastic deformation. The brittle-burst failure mechanism may be different from other mechanisms, such as yield-failure, that result from plastic or other similar types of deformation. Additionally, the brittle-burst strength can be lower than a burst rating based on the Barlow Equation and the rupture pressure based on the Klever-Stewart model. Thus, the standard tubular design with carbon-based steel may not be sufficient for retaining tubular integrity during a wellbore operation. Additionally, wellbore operations can use carbon steel tubulars or piping instead of resource-heavy, alloy steel tubulars or piping for operations involving minor and medium sour environments. The purpose can include significantly reducing the resources used for producing and installing production casing and tubing, etc. But, the carbon steel tubulars may not be feasible if wellbore or tubular integrity is affected by brittle-burst failure.

A fracture toughness can be modeled as a function of hydrogen sulfide concentration, temperature, and pH. Additionally, a brittle-burst strength calculation can be integrated with a thermal-flow simulation module and stress analysis to analyze the integrity of a well system tubular. And, at least two types of fracture failure mechanisms, which can include unstable propagation of a pre-existing crack and an initiation of a new sharp crack, can be considered. Using the above, a brittle-burst strength can be determined for a well system tubular for identifying an integrity design limit of the well system tubular. The brittle-burst strength can reduce resources for producing and installing tubulars with respect to a wellbore that includes a sour environment. Additionally, the brittle-burst strength can provide a more comprehensive stress analysis for generating a higher confidence in wellbore and tubular integrity compared to other wellbore integrity analysis techniques. The brittle-burst strength can provide seamless integration with existing tubular design modules to provide convenience and reduce time for identifying the integrity of the well system tubular.

A brittle-burst strength and tubular design workflow can be used and integrated into a thermal flow simulation for a well system tubular design in a sour environment. Input parameters, such as wellbore configuration, flow rates, fluid composition, fracture toughness, pre-existing crack depth, and crack initiation threshold stress, etc., can be provided via a user interface provided by a computing device or via other suitable input channels. In some examples, the computing device may access and receive the input parameters via an existing data repository. The computing device can use the input parameters to execute a thermal flow simulation to obtain profiles of pressure, temperature, flow velocity of the wellbore, and the like. The output results from the thermal flow simulation can be stored in the memory and can be used to determine fluid pH value, hydrogen sulfide activity, and the like via a crack propagation model. The outputs can also used to determine the API 5C3 standard burst strength based on the Barlow Equation and to determine a crack-initiation fracture pressure using a crack initiation model.

At least two types of fracture failures for the wellbore tubular can be considered for brittle-burst strength. One type of fracture failure can include crack propagation failure due to unstable propagation of a pre-existing crack. Another type of fracture failure can include crack initiation failure due to initiation and stable growth of a crack where there previously was no detectable crack. In some examples, the crack initiation failure can involve environmental cracking, which can occur independently of fracture propagation, of the well system tubular. Thus, in some examples, the brittle-burst strength may be the lower of crack-propagation fracture pressure and crack-initiation fracture pressure. In some examples, the crack-propagation fracture pressure, the crack-initiation fracture pressure, or a combination thereof may be compared to the standard burst strength, and the brittle-burst strength may be determined to be the optimized, such as the lowest, etc., value among the crack-propagation fracture pressure, the crack-initiation fracture pressure, and the standard burst strength.

The crack propagation model may involve a crack depth, a fracture toughness, and the like as inputs. Fracture toughness can be determined using the outputs from the thermal flow simulation or other suitable inputs, and fracture toughness can be affected by temperature, pH, hydrogen sulfide concentration, or a combination thereof. The hydrogen sulfide concentration and solution pH value can be determined based on water chemistry and gas composition. The effects of temperature, hydrogen sulfide concentration, pH, and the like on fracture toughness can be simulated using:

$$K_{1mat}=K_{1mat0}*\text{temp}*H_2S*\text{pH} \quad \text{(Equation 1)}$$

where $K_{1mat0}$ is the fracture toughness of the wellbore tubular under standard conditions in air and $K_{1mat}$ is the fracture toughness of the well system tubular subject to the sour environment. Additionally the temperature factor, the hydrogen sulfide factor, and the pH factor for the tubular can be determined, respectively, by:

$$temp = \left(\frac{YS}{YS_0}\right)^{(1-\alpha)} = \text{YS_temp_duration_factor}^{-2.5} \quad \text{(Equation 2)}$$

$$H_2S = \frac{15.026}{57.0} * [H_2S]^{-0.12} \quad \text{(Equation 3)}$$

$$\text{pH} = \frac{(2.74 * \text{pH} - 0.07 * \text{time} + 161.20)}{178.0} \quad \text{(Equation 4)}$$

where $[H_2S]$ is the concentration of hydrogen sulfide, time is operation duration in days, and pH can be estimated using water chemistry and gas composition or can be input as a parameter from a user interface.

After simulating the effects of temperature, pH, and hydrogen sulfide concentration, or other sour compound concentration, the crack-propagation fracture pressure can be obtained by numerically solving a fracture limit-state equation of unstable propagation of a pre-existing crack. The crack-initiation fracture pressure can be obtained by setting the von Mises equivalent stress equal to the threshold stress of crack initiation. In some examples, if the threshold stress is approximately 90% of the yield strength of the wellbore tubular, then the crack-initiation fracture pressure can be determined. The brittle-burst strength may be the lesser of the crack-initiation fracture pressure, the crack-propagation fracture pressure, and the standard burst strength.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 with a tubular 102 according to one example of the present disclosure. The well system 100 can include a wellbore 104 extending through various earth strata. The wellbore 104 can extend through a subterranean formation 106 that can include hydrocarbon material such as oil, gas, coal, or other suitable material. In some examples, the tubular 102 can extend from a well surface 122 into the subterranean formation 106. The tubular 102 can provide a conduit through which formation fluids, such as production fluids produced from the subterranean formation 106, can travel to the well surface 122. Additionally, the tubular 102 can allow a well tool 108 to be positioned in the wellbore 104 for performing one or more wellbore operations. The tubular 102 can be coupled to walls of the wellbore 104 via cement or other suitable coupling material. For example, a cement sheath 110 can be positioned or formed between the tubular 102 and the walls of the wellbore 104 for coupling the tubular 102 to the wellbore 104. The tubular 102 can be coupled to the wellbore 104 using other suitable techniques. Additionally, while illustrated as a downhole tubular, the tubular 102 may instead be or include a surface tubular, such as a pipeline, that can be exposed to a sour environment at the well surface 122.

In some examples, the tubular 102 can include carbon-based steel or other suitable types of carbon-based steel alloys. Additionally, the wellbore 104 can include or provide a sour environment that includes water, carbon dioxide, hydrogen sulfide, or any combination thereof. The sour environment may cause the tubular 102 to degrade due to the material, such as the carbon-based steel, of the tubular 102 interacting with the sour environment. Thus, the integrity of the tubular 102 may be measured, estimated, predicted, or the like to ensure that the tubular 102 does not fail while positioned with respect to the wellbore 104. The well system 100 can include a computing device 140 that can analyze the tubular 102 to determine the integrity of the tubular 102 with respect to the environment provided by the wellbore 104 or the well system 100.

The computing device 140 can be positioned at the surface 122 of the well system 100. In some examples, the computing device 140 can be positioned downhole in the wellbore 104, remote from the well system 100, or in other suitable locations with respect to the well system 100. The computing device 140 can be communicatively coupled to any suitable component such as the well tool 108, etc. For example, as illustrated in FIG. 1, the computing device 140 can include an antenna 142 that can allow the computing device 140 to receive and to send communications relating to the well system 100, the tubular 102, and the like. The computing device 140 can receive data relating to the wellbore 104, to the well system 100, or a combination thereof. The computing device 140 can use the received data to determine a brittle-burst strength for the tubular 102. In some examples, the computing device 140 can output the brittle-burst strength for use in optimizing the tubular 102 with respect to the well system 100. The design of the tubular 102, the position of the tubular 102, and the like can be optimized.

Figure 2:
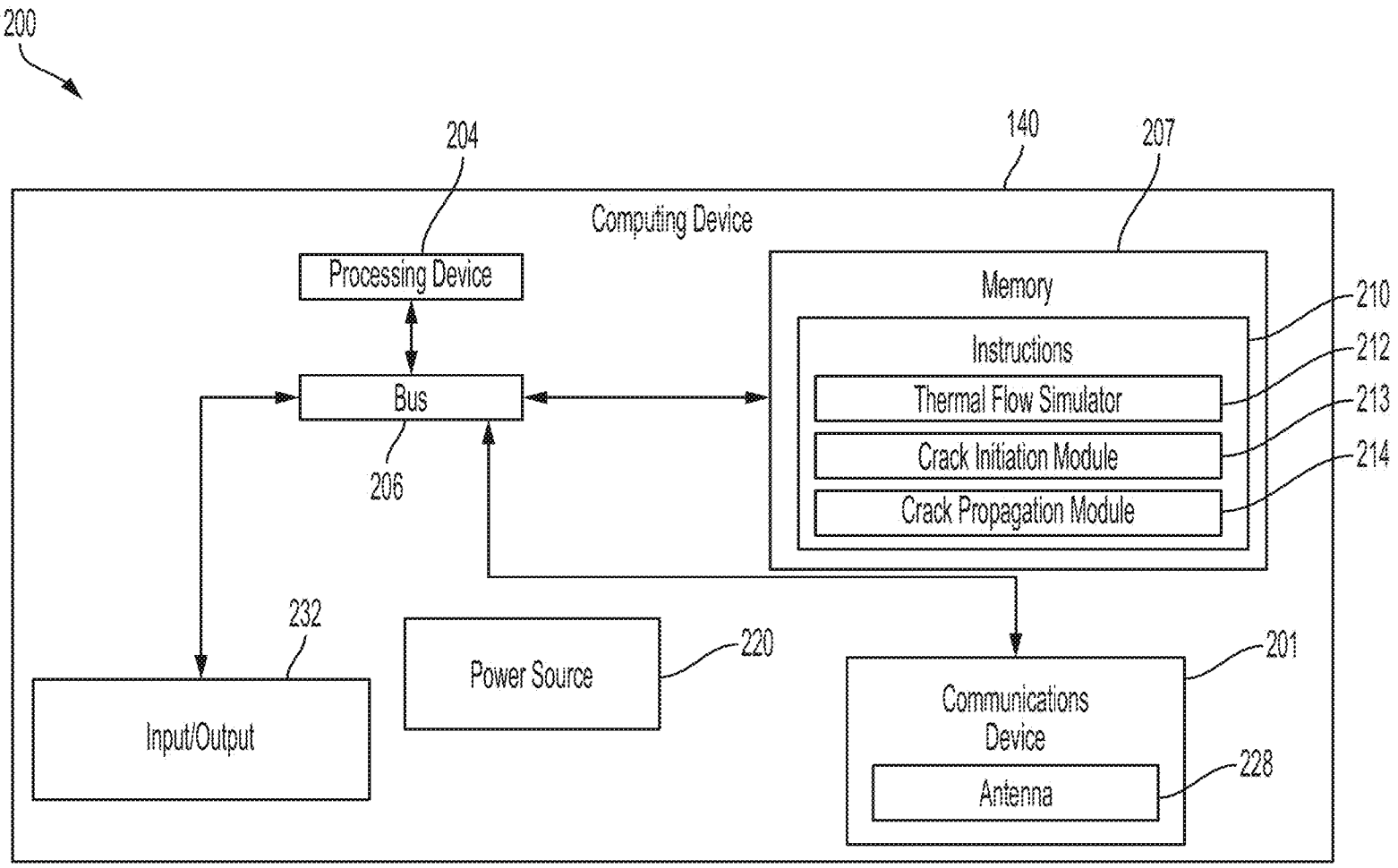
FIG. 2 is a block diagram of a computing system for determining an integrity of a tubular using brittle-burst strength according to one example of the present disclosure.

FIG. 2 is a block diagram of a computing system 200 for determining an integrity of a tubular 102 using a brittle-burst strength of the tubular 102 according to one example of the present disclosure. The computing system 200 can include the computing device 140. Components illustrated in FIG. 2 may be integrated into a single structure, such as in a single housing of the computing device 140. Alternatively, the components shown in FIG. 2 may be distributed from other components and in electrical communication with the other components.

The computing device 140 can include a processing device 204, a memory device 207, an input/output device 232, and a power source 220 that can be communicatively coupled via a bus 206. The input/output device 232 can include a display device, such as a screen or a monitor. Additionally, the input/output device 232 can include a keyboard or a mouse. A user can view data relating to the tubular 102 via the display device and can provide input to the computing device 140 via the input/output device 232, for example via a user interface provided by the computing device 140. The input can be used by the computing device 140 to determine the brittle-burst strength of, and other information relating to, the tubular 102.

The processing device 204 can include one processing device or multiple processing devices. Non-limiting examples of the processing device 204 can include a Field-Programmable Gate Array (FPGA), an application-specific integrated circuit (ASIC), a micro-processing device, etc. The processing device 204 can execute instructions 210 stored in the memory device 207 to perform operations. In some examples, the instructions 210 can include processing device-specific instructions generated by a compiler or an interpreter from code written in any suitable computer-programming language such as C, C++, C#, Java, Perl, Python, etc.

The processing device 204 can be communicatively coupled to the memory device 207 via the bus 206. The memory device 207 can include one memory or multiple memories and can be non-volatile and may include any type of memory that retains stored information when powered off. Non-limiting examples of the memory can include electrically erasable and programmable read-only memory (EEPROM), flash memory, or any other type of non-volatile memory. At least some of the memory can include a non-transitory computer-readable medium from which the processing device 204 can read the instructions 210. The non-transitory computer-readable medium can include electronic, optical, magnetic, or other storage devices capable of providing the processing device 204 with computer-readable instructions 210 or other program code. Examples of the non-transitory computer-readable medium include magnetic disk(s), memory chip(s), ROM, random-access memory (RAM), an ASIC, a configured processing device, optical storage, or any other medium from which a computer processing device can read the instructions 210.

In some examples, the memory device 207 can include instructions 210 for causing the processing device 204 to determine the brittle-burst strength for the tubular 102. In some examples, the processing device 204 can access the instructions 210 via the memory device 207 to execute one or more of a thermal flow simulator 212, a crack initiation module 213, or a crack propagation module 214. The thermal flow simulator 212 can be executed by the processing device 204 to determine pressure, temperature, and the like with respect to fluid flow in the tubular 102. The crack initiation module 213 can be executed by the processing device 204 to determine a crack-initiation fracture pressure with respect to the tubular 102. The crack propagation module 214 can be executed by the processing device 204 to determine a crack-propagation fracture pressure with respect to the tubular 102. The instructions 210 can additionally include instructions executable by the processing device 204 for causing the processing device 204 to generate or identify the brittle-burst strength for the tubular 102.

The computing device 140 can include a power source 220. The power source 220 can be in electrical communication with the computing device 140 and the communications device 201. In some examples, the power source 220 can include a battery or an electrical cable such as a wireline. The power source 220 can include an AC signal generator. The computing device 140 can operate the power source 220 to apply a transmission signal to the antenna 228 to generate electromagnetic waves that convey data relating to the well system 100, the tubular 102, etc. to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 201 can be implemented in software. For example, the communications device 201 can include additional instructions stored in the memory device 207 for controlling functions of the communication device 201. The communications device 201 can receive signals from remote devices and transmit data to remote devices. For example, the communications device 201 can transmit wireless communications that are modulated by data via the antenna 228. In some examples, the communications device 201 can receive signals (e.g., associated with data to be transmitted) from the processing device 204 and amplify, filter, modulate, frequency shift, or otherwise manipulate the signals. In some examples, the communications device 201 can transmit the manipulated signals to the antenna 228. The antenna 228 can receive the manipulated signals and responsively generate wireless communications that carry the data.

Figure 3:
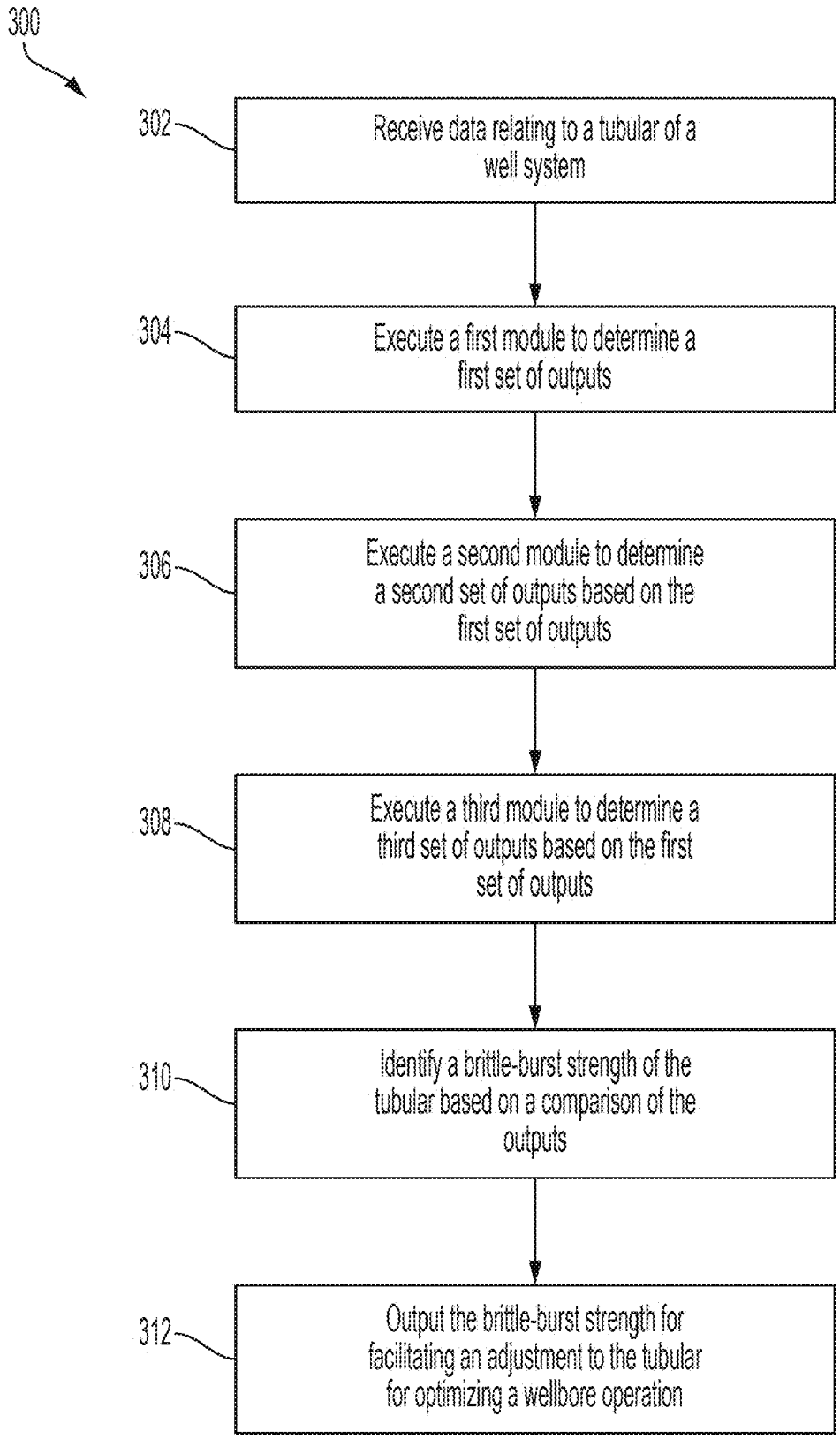
FIG. 3 is a flowchart of a process for determining an integrity of a tubular using brittle-burst strength according to one example of the present disclosure.

FIG. 3 is a flowchart of a process 300 for determining an integrity of a tubular 102 using brittle-burst strength according to one example of the present disclosure. At block 302, the computing device 140 receives data relating to the tubular 102. The computing device 140 may receive the data via user input, for example via user input into a user interface provided by the computing device 140, by accessing a data repository that includes the data, by other suitable techniques, or any combination thereof. The data can include characteristics relating to the tubular 102, characteristics relating to an environment associated with the well system 100, and the like. For example, the received data can include a fracture toughness of the tubular 102, a crack initiation threshold of the tubular 102, a thickness of the tubular 102, an imperfection depth of the tubular 102, etc. Additionally, the received data can include a concentration or amount of water in the environment, a concentration or amount of hydrogen sulfide in the environment, a concentration or amount of carbon dioxide in the environment, and the like. In some examples, the environment may be or include the environment downhole in the wellbore 104, the environment at the well surface 122, or a combination thereof.

At block 304, the computing device 140 executes a thermal flow simulator 212 to determine a first set of outputs. The computing device 140 can input the received data into the thermal flow simulator 212, which can output the first set of outputs that includes pressure conditions, temperature conditions, and the like relating to flow with respect to the tubular 102. In some examples, the computing device 140 determines or receives well configuration data, flow rate data, fluid composition data, and the like relating to the tubular 102. The computing device 140 executes a thermal flow simulation using the well configuration data, the flow rate data, the fluid composition data, etc. associated with the tubular 102. The computing device 140, in response to executing the thermal flow simulation, determines profiles of pressure, profiles of temperature, and the like for the tubular 102. The profile of pressure may include pressure conditions of the tubular 102 during the simulated flow, the profile of temperature may include temperature conditions of the tubular 102 during the simulated flow, etc. The computing device 140 may generate the first set of outputs based on the outputs returned by the thermal flow simulation. For example, the computing device 140 may combine the outputs, which may include the profiles of pressure and temperature, etc., from the thermal flow simulation to generate the first set of outputs.

At block 306, the computing device 140 executes a crack initiation module 213 to determine a second set of outputs based on the first set of outputs. The first set of outputs, including for example the pressure conditions and the temperature conditions relating to the tubular 102, can be input by the computing device 140 into the crack initiation module 213 to generate the second set of outputs. In some examples, the second set of outputs includes a crack-initiation fracture pressure that indicates a threshold pressure over which a crack may be likely to be initiated in the tubular 102. The computing device 140 can input the first set of outputs, for example including the profiles of pressure and the profiles of temperature each for the tubular 102, into the crack initiation module 213 to generate the second set of outputs that includes the crack-initiation fracture pressure. In some examples, the computing device 140 inputs a crack initiation threshold stress into the crack initiation module 213 to generate the crack-initiation fracture pressure. The crack initiation threshold stress may be or include a characteristic of the tubular 102 that indicates a threshold amount of stress that the tubular 102 can experience before a potential crack initiates or forms in the tubular 102.

At block 308, the computing device 140 executes a crack propagation module 214 to determine a third set of outputs based on the first set of outputs. In some examples, the third set of outputs includes a crack-propagation fracture pressure that indicates a threshold pressure over which an existing crack in the tubular 102 may propagate or otherwise increase in size, depth, etc. The computing device 140 can input the first set of outputs, which may include the pressure conditions and the temperature conditions relating to the tubular 102, into the crack propagation module 214 to generate the third set of outputs. In some examples, the computing device 140 inputs a fracture toughness into the crack propagation module 214 to generate the crack-propagation fracture pressure. The fracture toughness may be or include a characteristic of the tubular 102 that indicates how resistant the tubular 102 is to an existing crack propagating. In some examples, the fracture toughness can be separately determined by the computing device 140. Additionally or alternatively, the computing device 140 may integrate the crack initiation module 213 and the crack propagation module 214 into the thermal flow simulator 212 for determining a brittle-burst strength of the tubular 102.

At block 310, the computing device 140 identifies a brittle-burst strength of the tubular 102 based on a comparison involving the second set of outputs and the third set of outputs. In some examples, the comparison includes comparing the crack-initiation fracture pressure, the crack-propagation fracture pressure, and a standard burst strength of the tubular 102. The standard burst strength may be separately determined or received by the computing device 140 and may correlate to the first set of outputs such as the profiles of pressure of the tubular 102, the profiles of temperatures of the tubular 102, and the like. The computing device 140 can determine which of the crack-initiation fracture pressure, the crack-propagation fracture pressure, and a standard burst strength is the smallest and can determine that the smallest value is the brittle-burst strength of the tubular 102. For example, the crack-propagation fracture pressure may be a smaller value than the crack-initiation fracture pressure and a smaller value than the standard burst strength, so the computing device 140 determines that the crack-propagation fracture pressure is the brittle-burst strength of the tubular 102. In other words, the computing device 140 may execute the following function:

$$BB=\min(p_{iF1}, p_{iF2}, p_{iY0}) \quad \text{(Equation 5)}$$

where BB is the brittle-burst strength, $p_{iF1}$ is the crack-propagation fracture pressure, $p_{iF2}$ is the crack-initiation fracture pressure, and $p_{iY0}$ is the standard burst strength.

At block 312, the computing device 140 outputs the brittle-burst strength of the tubular 102 for analyzing the integrity of the tubular 102. Additionally, the computing device 140 can output the brittle-burst strength to optimize one or more wellbore operations performed with the tubular 102. For example, the brittle-burst strength can be provided to an entity, such as an operator, engineer, manager, etc., of a wellbore operation that can make adjustments to the wellbore operation based on the provided brittle-burst strength. The entity may determine that the brittle-burst strength of the tubular 102 is too low for a particular wellbore operation and may adjust the design, amount, type, position or the like of the tubular 102 to optimize the particular wellbore operation.

The computing device 140 may determine that the brittle-burst strength of the tubular 102 indicates that the tubular 102 is not optimized for the particular wellbore operation and can recommend adjustments to characteristics, such as a design, amount, type, position or the like, of the tubular 102 to optimize the particular wellbore operation. For example, the computing device 140 can determine that the brittle-burst strength of the tubular 102 is too low for a production operation involving a wellbore with a sour environment. The computing device 140 can provide, for example via a user interface, the brittle-burst strength to the entity. Additionally, the computing device 140 can generate recommendations for adjusting one or more characteristics of the tubular 102. For example, the computing device 140 can generate a recommendation to re-position the tubular 102 in the wellbore, to replace the tubular 102 with a different, optimized tubular, or the like. In some examples, the computing device 140 can output a command for adjusting the one or more characteristics of the tubular 102. The command may involve automatically repositioning the tubular 102, removing the tubular 102 from the wellbore, etc.

Figure 4:
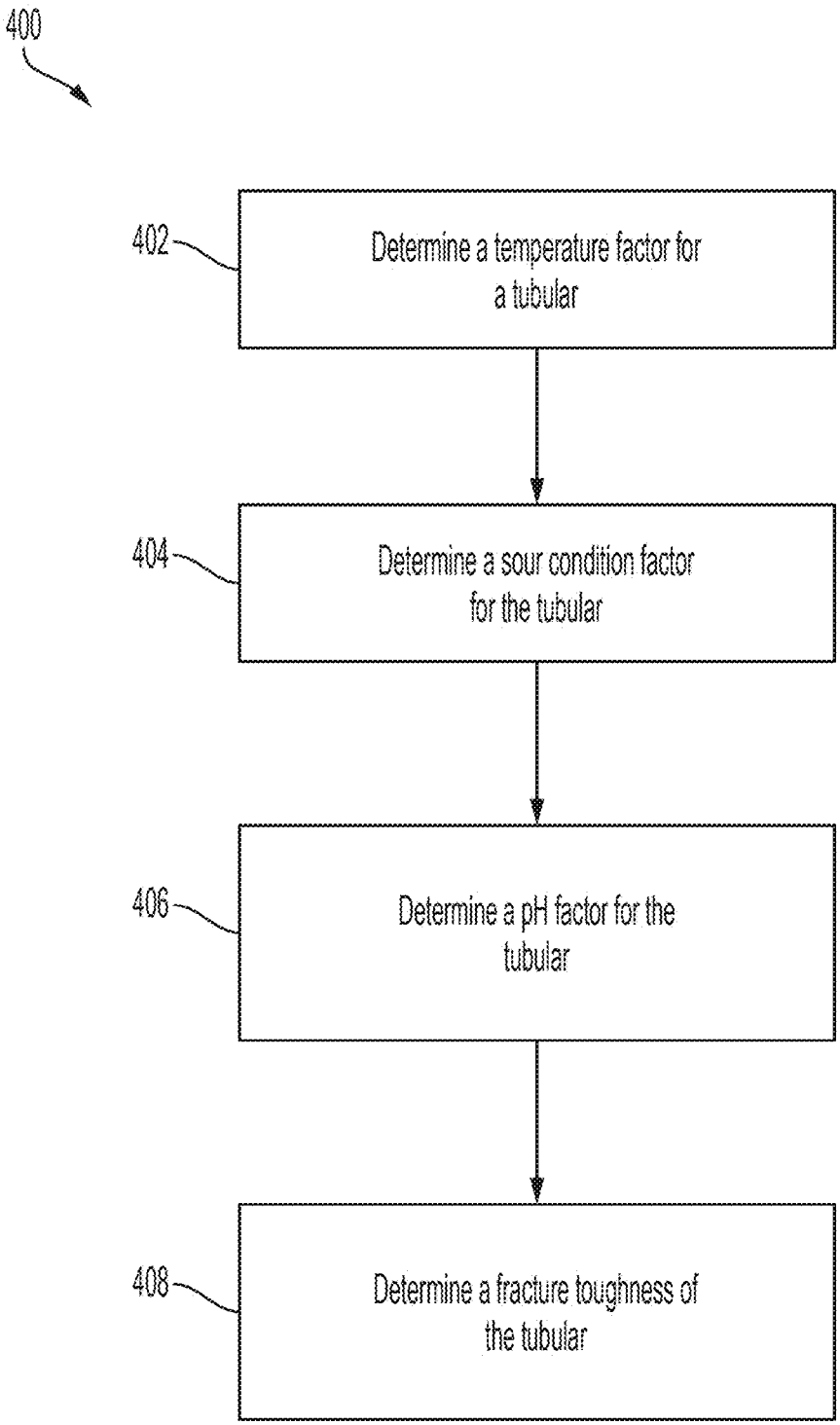
FIG. 4 is a flowchart of a process for determining a fracture toughness of a tubular according to one example of the present disclosure.

FIG. 4 is a flowchart of a process 400 for determining a fracture toughness of a tubular 102 according to one example of the present disclosure. At block 402, the computing device 140 determines a temperature factor relating to a tubular 102. In some examples, the tubular 102 is a downhole tubular that can be positioned in the wellbore 104, a surface tubular that can be positioned at the well surface 122, or the like. The temperature factor may indicate a degree to which the temperature experienced by the tubular 102 affects the toughness or fracture resistance of the tubular 102. Additionally, the temperature factor of the tubular 102 disposed in an environment may be proportional to the temperature factor of the tubular 102 in air. In some examples, the temperature factor for the tubular 102 can be determined using Equation 2 presented and described above.

At block 404, the computing device 140 determines a sour environment factor relating to the tubular 102. The sour environment factor may indicate a degree to which the sour conditions experienced by the tubular 102 affects the toughness or fracture resistance of the tubular 102. The sour conditions may involve the tubular 102 being exposed to hydrogen sulfide, carbon dioxide, or other suitable sour compounds that may negatively affect the integrity of the tubular 102. Additionally, the sour environment factor of the tubular 102 disposed in a sour environment may be proportional to the sour environment factor of the tubular 102 in air. In some examples, the sour environment factor for the tubular 102 can be determined using Equation 3 presented and described above.

At block 406, the computing device 140 determines a pH factor relating to the tubular 102. The pH factor may indicate a degree to which the pH experienced by the tubular 102 affects the toughness or fracture resistance of the tubular 102. Additionally, the pH factor of the tubular 102 disposed in the wellbore 104 or at the well surface 122, etc. may be proportional to the pH factor of the tubular 102 in air and to an amount of time in which the tubular 102 is exposed to a particular pH. In some examples, the pH factor for the tubular 102 can be determined using Equation 4 presented and described above.

At block 408, the computing device 140 determines a fracture toughness of the tubular 102. The fracture toughness may be or include a characteristic of the tubular 102 that indicates a resistance of the tubular 102 to cracks or other similar deformations such as ductile bursts, and the like. The fracture toughness may be related to the temperature factor of the tubular 102, the sour environment factor of the tubular 102, the pH factor of the tubular 102, other suitable factors of the tubular 102, or any combination thereof. The computing device 140 can combine, or otherwise use, the temperature factor of the tubular 102, the sour environment factor of the tubular 102, and the pH factor of the tubular 102 to determine the fracture toughness of the tubular 102. In some examples, the fracture toughness of the tubular 102 can be determined using Equation 1 presented and described above.

Figure 5:
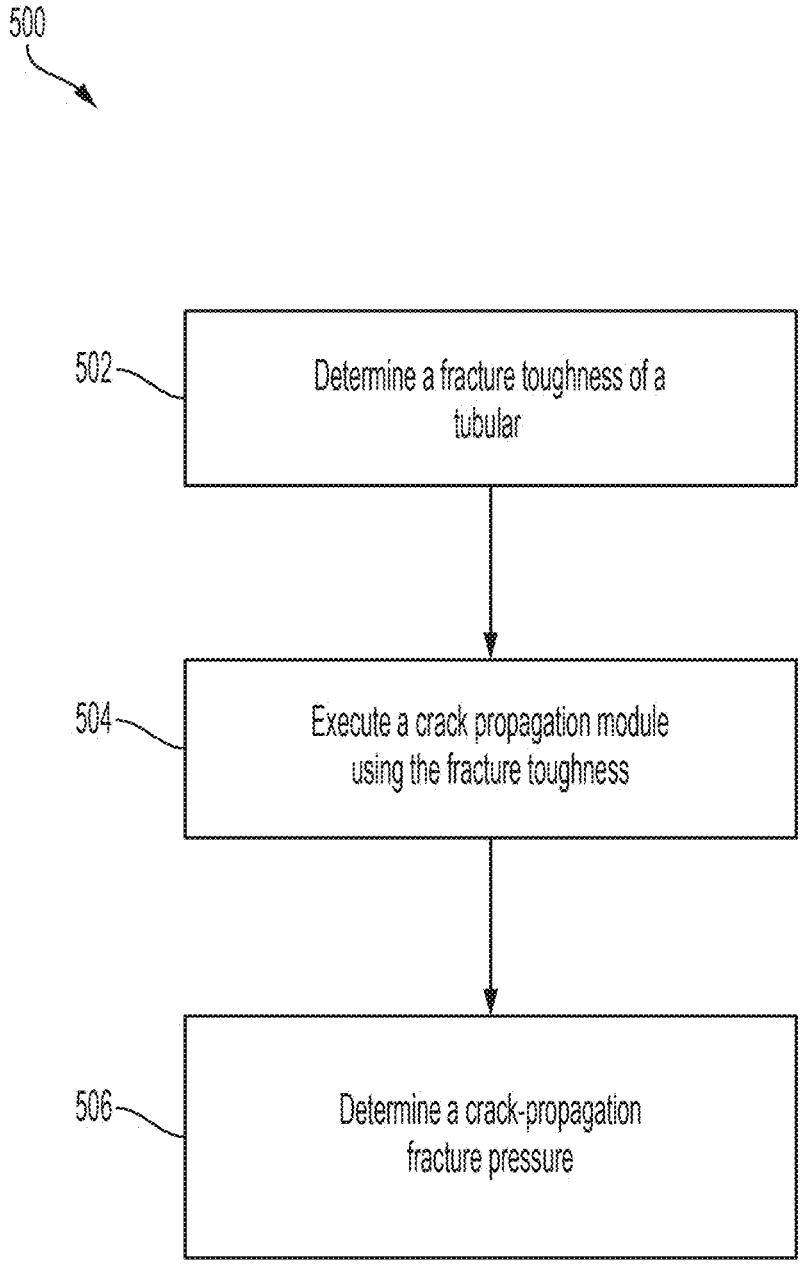
FIG. 5 is a flowchart of a process for using fracture toughness of a tubular to determine a crack-propagation fracture pressure according to one example of the present disclosure.

FIG. 5 is a flowchart of a process 500 for using fracture toughness to determine a crack-propagation fracture pressure according to one example of the present disclosure. At block 502, the computing device 140 determines a fracture toughness of a tubular 102. In some examples, the tubular 102 is a downhole tubular that can be positioned in the wellbore 104, a surface tubular that can be positioned at the well surface 122, or the like. The fracture toughness may indicate a resistance of the tubular 102 to cracking or other similar deformations such as ductile burst, etc. In some examples, the fracture toughness is determined using techniques described with respect to the block 408 of the process 400. The fracture toughness can correspond to the temperature factor of the tubular 102, the sour environment factor of the tubular 102, the pH factor of the tubular 102, etc. In some examples, the computing device 140 can receive, for example instead of determine, the fracture toughness of the tubular 102, for example via user input.

At block 504, the computing device 140 executes a crack propagation module 214 using the fracture toughness. The computing device 140 can determine or receive the fracture toughness and can input the fracture toughness into the crack propagation module 214 to execute the crack propagation module 214. Executing the crack propagation module 214 may involve simulating a propagation of a crack that exists in the tubular 102. In some examples, the computing device 140 may numerically solve an equation that relates the propagation of a crack to the fracture toughness.

At block 506, the computing device 140 determines a crack-propagation fracture pressure. The crack-propagation fracture pressure may be a pressure at which an existing crack in the tubular 102 begins to propagate along the tubular 102. In some examples, the crack-propagation fracture pressure may be an output or other suitable result of executing the crack propagation module 214. Thus, the crack-propagation fracture pressure may depend on the fracture toughness of the tubular 102.

Figure 6:
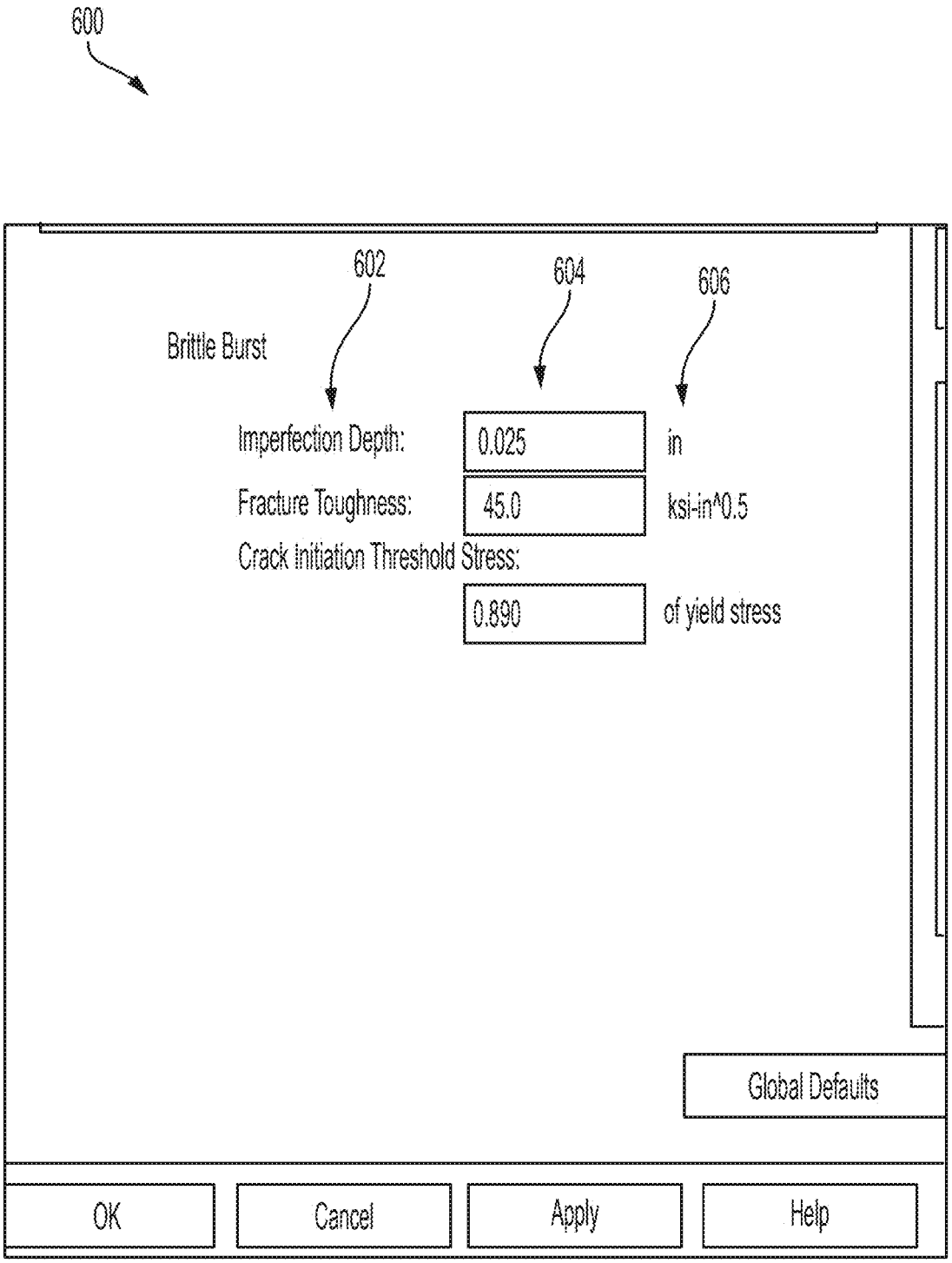
FIG. 6 is an example of a user interface that can be used for receiving input to determine an integrity of a tubular using brittle-burst strength according to one example of the present disclosure.

FIG. 6 is an example of a user interface 600 that can be used for receiving input to determine a brittle-burst strength for a tubular 102 according to one example of the present disclosure. As illustrated, the user interface 600 includes three columns: a parameter column 602, an input column 604, and a units column 606. The parameter column 602 may list various parameters that can be input via the user interface 600. For example, the parameters can include characteristics of the tubular 102, characteristics of the environment of the well system 100, etc. The input column 604 may include one or more interactive fields that can be used by a user of the computing device 140 to input values corresponding to the parameters of the parameter column 602. The units column 606 can list units associated with the parameters of the parameter column 602 and may indicate to the user what type of value to input in the respective interactive fields of the input column 604.

The three columns may be horizontally offset from one another, and each column may include the same, similar, or different numbers of rows. For example, and as illustrated, each of the three columns includes three rows corresponding to imperfection depth, fracture toughness under standard conditions, and crack initiation stress threshold, though other suitable types of parameters are possible. The rows may correspond to characteristics of the tubular 102, the environment in which the tubular 102 may be disposed, or the like. As illustrated, the rows correspond to characteristics of the tubular 102, though the rows may additionally or alternatively include fields corresponding to characteristics about the environment.

In some aspects, systems, methods, and non-transitory computer-readable mediums for determining a brittle-burst strength for performing an integrity analysis for a well system tubular are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a non-transitory computer-readable memory device that includes instructions executable by the processing device for causing the processing device to perform operations comprising: receiving data relating to a tubular in a well system that includes a wellbore, the data comprising characteristics of the tubular and characteristics of an environment of the well system; executing a first module to determine a first set of outputs based on the data, the first set of outputs comprising pressure conditions and temperature conditions relating to the tubular; executing a second module to determine a second set of outputs based on the first set of outputs, the second set of outputs comprising a crack-initiation fracture pressure of the tubular; executing a third module to determine a third set of outputs based on the first set of outputs, the third set of outputs comprising a crack-propagation fracture pressure of the tubular; identifying a brittle-burst strength of the tubular by comparing the second set of outputs and the third set of outputs to a burst strength of the tubular, the brittle-burst strength being the lowest value of values for the crack-initiation fracture pressure, the crack-propagation fracture pressure, and the burst strength; and providing the brittle-burst strength of the tubular to facilitate an adjustment to the tubular to optimize a wellbore operation associated with the well system.

Example 2 is the system of example 1, wherein the tubular is a downhole tubular positionable downhole in the wellbore, and wherein the operation of outputting the brittle-burst strength of the tubular includes: generating an adjusted design of the downhole tubular based on the characteristics of the tubular, a subset of the characteristics of the environment of the well system that corresponds to an environment of the wellbore, and the brittle-burst strength of the tubular; and outputting, via a user interface, a recommendation for the adjusted design of the downhole tubular to optimize the wellbore operation.

Example 3 is the system of example 1, wherein the tubular is a surface tubular positionable at a surface of the wellbore, and wherein the operation of outputting the brittle-burst strength of the tubular includes: generating an adjusted design of the surface tubular based on the characteristics of the tubular, a subset of the characteristics of the environment of the well system that corresponds to an environment of the surface of the wellbore, and the brittle-burst strength of the tubular; and outputting, via a user interface, a recommendation for the adjusted design of the surface tubular to optimize the wellbore operation.

Example 4 is the system of example 1, wherein the operations further comprise determining a fracture toughness of the tubular in the environment of the well system, wherein the fracture toughness is proportional to a combination of the first set of outputs, a fracture toughness of the tubular in air, and a concentration of sour elements in the environment of the well system.

Example 5 is the system of any of examples 1 and 4, wherein the operation of executing the third module comprises inputting the fracture toughness of the tubular in the environment of the well system to determine the crack-propagation fracture pressure.

Example 6 is the system of example 1, wherein the operation of receiving data relating to the tubular comprises: providing a user interface that comprises a set of input fields corresponding to the characteristics of the tubular and the characteristics of the environment of the well system; and receiving, via user input into the user interface, the data relating to the tubular.

Example 7 is the system of any of examples 1 and 6, wherein the set of input fields comprises: a first input field corresponding to an imperfection depth of the tubular; a second input field corresponding to a fracture toughness of the tubular in air; and a third input field corresponding to a crack initiation threshold of the tubular; and wherein the operation of executing the second module comprises inputting the crack initiation threshold of the tubular into the second module to determine the crack-initiation fracture pressure for the tubular.

Example 8 is a method comprising: receiving, by a computing device, data relating to a tubular in a well system that includes a wellbore, the data comprising characteristics of the tubular and characteristics of an environment of the well system; executing, by the computing device, a first module to determine a first set of outputs based on the data, the first set of outputs comprising pressure conditions and temperature conditions relating to the tubular; executing, by the computing device, a second module to determine a second set of outputs based on the first set of outputs, the second set of outputs comprising a crack-initiation fracture pressure of the tubular; executing, by the computing device, a third module to determine a third set of outputs based on the first set of outputs, the third set of outputs comprising a crack-propagation fracture pressure of the tubular; identifying, by the computing device, a brittle-burst strength of the tubular by comparing the second set of outputs and the third set of outputs to a burst strength of the tubular, the brittle-burst strength being the lowest value among value for the crack-initiation fracture pressure, the crack-propagation fracture pressure, and the burst strength; and providing, by the computing device, the brittle-burst strength of the tubular to facilitate an adjustment to the tubular to optimize a wellbore operation associated with the well system.

Example 9 is the method of example 8, wherein the tubular is a downhole tubular positioned downhole in the wellbore, and wherein outputting the brittle-burst strength of the tubular includes: generating, by the computing device, an adjusted design of the downhole tubular based on the characteristics of the tubular, a subset of the characteristics of the environment of the well system that corresponds to an environment of the wellbore, and the brittle-burst strength of the tubular; and outputting, by the computing device and via a user interface, a recommendation for the adjusted design of the downhole tubular to optimize the wellbore operation.

Example 10 is the method of example 8, wherein the tubular is a surface tubular positioned at a surface of the wellbore, and wherein outputting the brittle-burst strength of the tubular includes: generating, by the computing device, an adjusted design of the surface tubular based on the characteristics of the tubular, a subset of the characteristics of the environment of the well system that corresponds to an environment of the surface of the wellbore, and the brittle-burst strength of the tubular; and outputting, by the computing device and via a user interface, a recommendation for the adjusted design of the surface tubular to optimize the wellbore operation.

Example 11 is the method of example 8, further comprising determining, by the computing device, a fracture toughness of the tubular in the environment of the well system, wherein the fracture toughness is proportional to a combination of the first set of outputs, a fracture toughness of the tubular in air, and a concentration of sour elements in the environment of the well system.

Example 12 is the method of any of examples 8 and 11, wherein executing the third module comprises inputting, by the computing device, the fracture toughness of the tubular in the environment of the well system to determine the crack-propagation fracture pressure.

Example 13 is the method of example 8, wherein receiving data relating to the tubular comprises: providing, by the computing device, a user interface that comprises a set of input fields corresponding to the characteristics of the tubular and the characteristics of the environment of the well system; and receiving, by the computing device and via user input into the user interface, the data relating to the tubular.

Example 14 is the method of any of examples 8 and 13, wherein the set of input fields comprises: a first input field corresponding to an imperfection depth of the tubular; a second input field corresponding to a fracture toughness of the tubular in air; and a third input field corresponding to a crack initiation threshold of the tubular; and wherein executing the second module comprises inputting, by the computing device, the crack initiation threshold of the tubular into the second module to determine the crack-initiation fracture pressure for the tubular.

Example 15 is a non-transitory computer-readable medium comprising instructions that are executable by a processing device for causing the processing device to perform operations comprising: receiving data relating to a tubular in a well system that includes a wellbore, the data comprising characteristics of the tubular and characteristics of an environment of the well system; executing a first module to determine a first set of outputs based on the data, the first set of outputs comprising pressure conditions and temperature conditions relating to the tubular; executing a second module to determine a second set of outputs based on the first set of outputs, the second set of outputs comprising a crack-initiation fracture pressure of the tubular; executing a third module to determine a third set of outputs based on the first set of outputs, the third set of outputs comprising a crack-propagation fracture pressure of the tubular; identifying a brittle-burst strength of the tubular by comparing the second set of outputs and the third set of outputs to a burst strength of the tubular, the brittle-burst strength being the lowest value of values for the crack-initiation fracture pressure, the crack-propagation fracture pressure, and the burst strength; and providing the brittle-burst strength of the tubular to facilitate an adjustment to the tubular to optimize a wellbore operation associated with the well system.

Example 16 is the non-transitory computer-readable medium of example 15, wherein the tubular is a downhole tubular positionable downhole in the wellbore, and wherein the operation of outputting the brittle-burst strength of the tubular includes: generating an adjusted design of the downhole tubular based on the characteristics of the tubular, a subset of the characteristics of the environment of the well system that corresponds to an environment of the wellbore, and the brittle-burst strength of the tubular; and outputting, via a user interface, a recommendation for the adjusted design of the downhole tubular to optimize the wellbore operation.

Example 17 is the non-transitory computer-readable medium of example 15, wherein the tubular is a surface tubular positionable at a surface of the wellbore, and wherein the operation of outputting the brittle-burst strength of the tubular includes: generating an adjusted design of the surface tubular based on the characteristics of the tubular, a subset of the characteristics of the environment of the well system that corresponds to an environment of the surface of the wellbore, and the brittle-burst strength of the tubular; and outputting, via a user interface, a recommendation for the adjusted design of the surface tubular to optimize the wellbore operation.

Example 18 is the non-transitory computer-readable medium of example 15, wherein the operations further comprise determining a fracture toughness of the tubular in the environment of the well system, wherein the fracture toughness is proportional to a combination of the first set of outputs, a fracture toughness of the tubular in air, and a concentration of sour elements in the environment of the well system, and wherein the operation of executing the third module comprises inputting the fracture toughness of the tubular in the environment of the well system to determine the crack-propagation fracture pressure.

Example 19 is the non-transitory computer-readable medium of example 15, wherein the operation of receiving data relating to the tubular comprises: providing a user interface that comprises a set of input fields corresponding to the characteristics of the tubular and the characteristics of the environment of the well system; and receiving, via user input into the user interface, the data relating to the tubular.

Example 20 is the non-transitory computer-readable medium of any of examples 15 and 19, wherein the set of input fields comprises: a first input field corresponding to an imperfection depth of the tubular; a second input field corresponding to a fracture toughness of the tubular in air; and a third input field corresponding to a crack initiation threshold of the tubular; and wherein the operation of executing the second module comprises inputting the crack initiation threshold of the tubular into the second module to determine the crack-initiation fracture pressure for the tubular.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a non-transitory computer-readable memory device that includes instructions executable by the processing device for causing the processing device to perform operations comprising:

receiving data relating to a tubular in a well system that includes a wellbore, the data comprising characteristics of the tubular and characteristics of an environment of the well system;

executing a first module to determine a first set of outputs based on the data, the first set of outputs comprising pressure conditions and temperature conditions relating to the tubular;

executing a second module to determine a second set of outputs based on the first set of outputs, the second set of outputs comprising a crack-initiation fracture pressure of the tubular;

determining fracture toughness of the tubular in the environment of the well system, the fracture toughness of the tubular in the environment of the well system being proportional to a combination of a fracture toughness of the tubular in air, the first set of outputs, a concentration of a solution of hydrogen sulfide in the environment, and a pH of the solution of the hydrogen sulfide in the environment;

executing, based on the first set of outputs and the fracture toughness of the tubular in the environment of the well system, a third module to determine a third set of outputs, the third set of outputs comprising a crack-propagation fracture pressure of the tubular;

identifying a brittle-burst strength of the tubular by comparing the second set of outputs and the third set of outputs to a burst strength of the tubular, the brittle-burst strength being the lowest value of values for the crack-initiation fracture pressure, the crack-propagation fracture pressure, and the burst strength; and adjusting, using the brittle-burst strength of the tubular, one or more parameters of the tubular to optimize a wellbore operation associated with the well system, wherein the adjusting comprises outputting a command configured to cause the tubular to be repositioned with respect to the wellbore.

2. The system of claim 1, wherein the tubular is a downhole tubular positionable downhole in the wellbore, and wherein the operation of outputting the brittle-burst strength of the tubular includes:

generating an adjusted design of the downhole tubular based on the characteristics of the tubular, a subset of the characteristics of the environment of the well system that corresponds to an environment of the wellbore, and the brittle-burst strength of the tubular; and outputting, via a user interface, a recommendation for the adjusted design of the downhole tubular to optimize the wellbore operation.

3. The system of claim 1, wherein the tubular is a surface tubular positionable at a surface of the wellbore, and wherein the operation of outputting the brittle-burst strength of the tubular includes:

generating an adjusted design of the surface tubular based on the characteristics of the tubular, a subset of the characteristics of the environment of the well system that corresponds to an environment of the surface of the wellbore, and the brittle-burst strength of the tubular; and outputting, via a user interface, a recommendation for the adjusted design of the surface tubular to optimize the wellbore operation.

4. The system of claim 1, wherein the operation of receiving data relating to the tubular comprises:

providing a user interface that comprises a set of input fields corresponding to the characteristics of the tubular and the characteristics of the environment of the well system; and receiving, via user input into the user interface, the data relating to the tubular.

5. The system of claim 4, wherein the set of input fields comprises:

a first input field corresponding to an imperfection depth of the tubular;

a second input field corresponding to a fracture toughness of the tubular in air; and a third input field corresponding to a crack initiation threshold of the tubular; and wherein the operation of executing the second module comprises inputting the crack initiation threshold of the tubular into the second module to determine the crack-initiation fracture pressure for the tubular.

6. The system of claim 1, wherein the concentration is a concentration of hydrogen sulfide in the environment of the well system, wherein the pH is a pH of hydrogen sulfide in the environment of the well system, and wherein the temperature is a temperature of hydrogen sulfide in the environment of the well system.

7. A method comprising:

receiving, by a computing device, data relating to a tubular in a well system that includes a wellbore, the data comprising characteristics of the tubular and characteristics of an environment of the well system;

executing, by the computing device, a first module to determine a first set of outputs based on the data, the first set of outputs comprising pressure conditions and temperature conditions relating to the tubular;

executing, by the computing device, a second module to determine a second set of outputs based on the first set of outputs, the second set of outputs comprising a crack-initiation fracture pressure of the tubular;

determining, by the computing device, fracture toughness of the tubular in the environment of the well system, the fracture toughness of the tubular in the environment of the well system being proportional to a combination of a fracture toughness of the tubular in air, the first set of outputs, a concentration of a solution of hydrogen sulfide in the environment, and a pH of the solution of the hydrogen sulfide in the environment;

executing, by the computing device and based on the first set of outputs and the fracture toughness of the tubular in the environment of the well system, a third module to determine a third set of outputs, the third set of outputs comprising a crack-propagation fracture pressure of the tubular;

identifying, by the computing device, a brittle-burst strength of the tubular by comparing the second set of outputs and the third set of outputs to a burst strength of the tubular, the brittle-burst strength being the lowest value among value for the crack-initiation fracture pressure, the crack-propagation fracture pressure, and the burst strength; and adjusting, by the computing device and using the brittle-burst strength of the tubular, one or more parameters of the tubular to optimize a wellbore operation associated with the well system, wherein the adjusting comprises outputting a command configured to cause the tubular to be repositioned with respect to the wellbore.

8. The method of claim 7, wherein the tubular is a downhole tubular positioned downhole in the wellbore, and wherein outputting the brittle-burst strength of the tubular includes:

generating, by the computing device, an adjusted design of the downhole tubular based on the characteristics of the tubular, a subset of the characteristics of the environment of the well system that corresponds to an environment of the wellbore, and the brittle-burst strength of the tubular; and outputting, by the computing device and via a user interface, a recommendation for the adjusted design of the downhole tubular to optimize the wellbore operation.

9. The method of claim 7, wherein the tubular is a surface tubular positioned at a surface of the wellbore, and wherein outputting the brittle-burst strength of the tubular includes:

generating, by the computing device, an adjusted design of the surface tubular based on the characteristics of the tubular, a subset of the characteristics of the environment of the well system that corresponds to an environment of the surface of the wellbore, and the brittle-burst strength of the tubular; and outputting, by the computing device and via a user interface, a recommendation for the adjusted design of the surface tubular to optimize the wellbore operation.

10. The method of claim 7, wherein receiving data relating to the tubular comprises:

providing, by the computing device, a user interface that comprises a set of input fields corresponding to the characteristics of the tubular and the characteristics of the environment of the well system; and receiving, by the computing device and via user input into the user interface, the data relating to the tubular.

11. The method of claim 10, wherein the set of input fields comprises:

a first input field corresponding to an imperfection depth of the tubular;

a second input field corresponding to a fracture toughness of the tubular in air; and a third input field corresponding to a crack initiation threshold of the tubular; and wherein executing the second module comprises inputting, by the computing device, the crack initiation threshold of the tubular into the second module to determine the crack-initiation fracture pressure for the tubular.

12. A non-transitory computer-readable medium comprising instructions that are executable by a processing device for causing the processing device to perform operations comprising:

receiving data relating to a tubular in a well system that includes a wellbore, the data comprising characteristics of the tubular and characteristics of an environment of the well system;

executing a first module to determine a first set of outputs based on the data, the first set of outputs comprising pressure conditions and temperature conditions relating to the tubular;

executing a second module to determine a second set of outputs based on the first set of outputs, the second set of outputs comprising a crack-initiation fracture pressure of the tubular;

determining fracture toughness of the tubular in the environment of the well system, the fracture toughness of the tubular in the environment of the well system being proportional to a combination of a fracture toughness of the tubular in air, the first set of outputs, a concentration of a solution of hydrogen sulfide in the environment, and a pH of the solution of the hydrogen sulfide in the environment;

executing, based on the first set of outputs and the fracture toughness of the tubular in the environment of the well system, a third module to determine a third set of outputs on the first set of outputs, the third set of outputs comprising a crack-propagation fracture pressure of the tubular;

identifying a brittle-burst strength of the tubular by comparing the second set of outputs and the third set of outputs to a burst strength of the tubular, the brittle-burst strength being the lowest value of values for the crack-initiation fracture pressure, the crack-propagation fracture pressure, and the burst strength; and adjusting, using the brittle-burst strength of the tubular, one or more parameters of the tubular to optimize a wellbore operation associated with the well system, wherein the adjusting comprises outputting a command configured to cause the tubular to be repositioned with respect to the wellbore.

13. The non-transitory computer-readable medium of claim 12, wherein the tubular is a downhole tubular positionable downhole in the wellbore, and wherein the operation of outputting the brittle-burst strength of the tubular includes:

generating an adjusted design of the downhole tubular based on the characteristics of the tubular, a subset of the characteristics of the environment of the well system that corresponds to an environment of the wellbore, and the brittle-burst strength of the tubular; and outputting, via a user interface, a recommendation for the adjusted design of the downhole tubular to optimize the wellbore operation.

14. The non-transitory computer-readable medium of claim 12, wherein the tubular is a surface tubular positionable at a surface of the wellbore, and wherein the operation of outputting the brittle-burst strength of the tubular includes:

generating an adjusted design of the surface tubular based on the characteristics of the tubular, a subset of the characteristics of the environment of the well system that corresponds to an environment of the surface of the wellbore, and the brittle-burst strength of the tubular; and outputting, via a user interface, a recommendation for the adjusted design of the surface tubular to optimize the wellbore operation.

15. The non-transitory computer-readable medium of claim 12, wherein the operation of receiving data relating to the tubular comprises:

providing a user interface that comprises a set of input fields corresponding to the characteristics of the tubular and the characteristics of the environment of the well system; and receiving, via user input into the user interface, the data relating to the tubular.

16. The non-transitory computer-readable medium of claim 15, wherein the set of input fields comprises:

a first input field corresponding to an imperfection depth of the tubular;

a second input field corresponding to a fracture toughness of the tubular in air; and a third input field corresponding to a crack initiation threshold of the tubular; and wherein the operation of executing the second module comprises inputting the crack initiation threshold of the tubular into the second module to determine the crack-initiation fracture pressure for the tubular.

* * * * *